United States Patent [19]

Suganami et al.

[11] 4,157,118

[45] Jun. 5, 1979

[54] AUTOMATIC CONTROL SYSTEMS FOR THE WORKING TOOL OF A CIVIL MACHINE

[75] Inventors: Takashi Suganami; Teruo Manzeki, both of Fujisawa; Tashiro Takeda, Hiratsuka; Tetsuya Nakayama, Fujisawa; Koh Shimizu, Hiratsuka; Keishiro Kurihara, Fujisawa; Tohru Fukumura, Hatano; Naomi Hatogai, Hiratsuka, all of Japan

[73] Assignee: Kabushiki Kaisha Komatsu Seisakusho, Tokyo, Japan

[21] Appl. No.: 828,444

[22] Filed: Aug. 29, 1977

[30] Foreign Application Priority Data

Aug. 31, 1976 [JP] Japan ..... 51-104544

[51] Int. Cl.[2] ..... A01B 63/111

[52] U.S. Cl. ..... 172/4.5; 172/7; 172/12

[58] Field of Search ..... 172/2, 3, 4, 4.5, 7, 172/9, 11, 12; 37/DIG. 1, DIG. 20; 214/673, 674, 762, 763, 764; 404/84

[56] References Cited

U.S. PATENT DOCUMENTS

| | | | |
|---|---|---|---|
| 2,902,979 | 9/1959 | Gurries et al. | 172/4.5 |
| 3,750,757 | 8/1973 | Saetti | 172/9 |
| 3,831,683 | 8/1974 | Ikeda et al. | 172/4.5 |
| 4,024,796 | 5/1977 | Theobald | 172/795 X |
| 4,031,964 | 6/1977 | Takahashi et al. | 172/9 |
| 4,044,838 | 8/1977 | Wooldridge | 172/2 |
| 4,045,893 | 9/1977 | Feinzilber et al. | 172/4.5 X |
| 4,064,945 | 12/1977 | Haney | 172/4 |

FOREIGN PATENT DOCUMENTS

| | | | |
|---|---|---|---|
| 2418578 | 11/1974 | Fed. Rep. of Germany | 172/3 |
| 2508620 | 8/1975 | Fed. Rep. of Germany | 172/7 |

*Primary Examiner*—Richard T. Stouffer

*Attorney, Agent, or Firm*—Ladas, Parry, Von Gehr, Goldsmith & Deschamps

[57] ABSTRACT

In a civil machine comprising a working tool provided on a vehicle with a travelling mechanism and a drive therefor, an automatic control system comprises a stroke detector for detecting the amount of stroke of a lifting cylinder operating to move the working tool up and down, an inclination angle detector for detecting the inclination angle of the vehicle, an arithmetic unit for obtaining data representative of the height of the working tool from the detection signals of the two detectors, and a control for operating the lifting cylinder by using the data to control the position of the working tool with high accuracy.

7 Claims, 4 Drawing Figures

AUTOMATIC CONTROL SYSTEMS FOR THE WORKING TOOL OF A CIVIL MACHINE

BACKGROUND OF THE INVENTION

This invention relates to automatic control systems for the working tool of a civil machine.

In a known automatic blade control system a laser light beam is emitted from a laser light emitting device provided at a predetermined position for providing a reference height, while the laser light beam thus emitted is received and detected by a light receiving device fixedly provided at a predetermined position on the blade of a vehicle, for instance, thereby to obtain a height signal and the height of the blade is automatically controlled with the aid of the height signal. In another known system an inclination angle meter is provided on a predetermined position on the frame of a blade, and the height of the blade is automatically controlled on the basis of a deviation signal between the output signal of the inclination angle meter representative of an inclination angle with respect to the horizontal reference plane and the preset angle of the frame.

However, the blade height control system utilizing the laser beam is disadvantageous in that it is intricate in arrangement, and high in cost, and it is impossible to fully perform its functions in dusty places because the laser light is obstructed by dust.

In the blade height control system utilizing the inclination angle of the frame of the blade, it is required to precisely detect the inclination angle. In the case where the inclination angle meter utilizes gravity (as in the case of a pendulum type inclination angle meter), it is affected by a moment due to the inclination of the vehicle in the longitudinal direction thereof, and therefore the output signal of the meter is often erroneous. Accordingly, the blade height control system is liable to operate erroneously.

A land-leveling or earth-moving operation is generally performed when a civil machine advances, and upon reversing the civil machine merely returns to the position from which it started without doing any work. When the civil machine is reversed the work tool, e.g. a blade, is lifted or floated by a manual operation. In the reverse movement of the civil machine, the work tool is released from an automatic mode and is lifted or floated by a manual operation. Accordingly, a manual operation to lift or float the work tool is required every time the civil machine is reversed resulting in lowering of work efficiency.

SUMMARY OF THE INVENTION

Accordingly, an object of this invention is to overcome the above-described difficulties accompanying a conventional automatic blade control system.

More specifically, an object of the invention is to provide an automatic control system for a working tool on a civil machine in which the height of the working tool can be controlled by a method completely different from a conventional one.

Another object of the invention is to provide an automatic control system for a working tool on a civil machine in which the effect of a moment due to the inclination of a vehicle forming the civil machine in the longitudinal direction of the vehicle is eliminated, thereby to automatically control the position of the working tool with high accuracy.

A further object of the invention is to provide an automatic control system for a working tool on a civil machine in which when the working tool is overloaded, the working tool is controlled in such a manner that the load applied to the working tool is decreased.

A still further object of the invention is to provide an automatic control system for a working tool on a civil machine in which a bad influence due to the fact that the inclination of a vehicle forming the civil machine is erroneously detected when the vehicle is accelerated for start, is completely prevented.

According to this invention, the stroke of a lifting cylinder for lifting the working tool is detected to obtain the inclination (or the height of the blade) of the frame with respect to the vehicle, while the inclination of the bulldozer body, in the longitudinal direction thereof, with respect to a horizontal reference plane is detected, and the stroke detection value is corrected by referring to the body inclination value to detect the true height of the working tool from the horizontal reference plane, whereby the height of the working tool is automatically controlled to a desired height from the horizontal reference plane with this true height of the working tool as the amount of feedback.

The novel features which are considered characteristic of this invention are set forth in the appended claims. This invention itself, however, as well as other objects and advantages thereof will be best understood by reference to the following detailed description of illustrative embodiments, when read in conjunction with the accompanying drawings.

Detailed Description of the Invention

Figure 1:
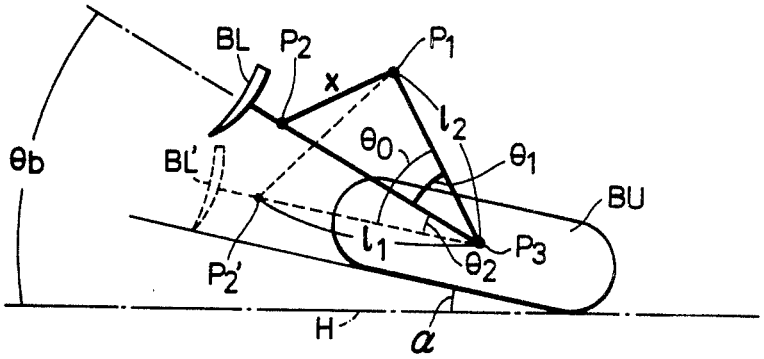
FIG. 1 is a schematic diagram for a description of a principle for detecting the present height of a working tool employed in this invention.

In order to provide a full understanding of this invention, a method for determining the true height of the blade of a bulldozer will be first described with reference to FIG. 1, in which reference character BU is intended to designate a bulldozer body or more specifically a track laid over sprockets, BL the present position of the blade, and BL' the position of the blade (indicated by the broken line) obtained when the frame supporting the blade is parallel with the longitudinal axis of the bulldozer body.

A point $P_1$ indicates the position of one end of a lift cylinder fixed to the body, while a point $P_2$ or $P_2'$ indicates the position of the other end of the lift cylinder fixed to the frame. Furthermore, a point $P_3$ indicates the position of the rotary shaft of the C-frame. A one-dot chain line H indicates a horizontal reference surface as viewed from side. The distance between the points $P_2'$ (or $P_2$) and the point $P_3$ is represented by $l_1$ while the distance between the points $P_1$ and $P_3$ is represented by $l_2$. Accordingly, the values $l_1$ and $l_2$ are constants inherent in the bulldozer. When the blade is at the position BL', the frame forms an angle $\theta_0$ with a straight line connecting the points $P_1$ and $P_3$, the length of which is equal to $l_2$. Accordingly, the value $\theta_0$ is also a constant of the bulldozer body. In addition, reference character X designates the distance between the points $P_1$ and $P_2$, that is, the stroke of the lift cylinder, and reference character $\theta_1$ designates the angle which the frame forms with the straight line connecting the points $P_1$ and $P_3$ when the blade is at the aforementioned present position.

Therefore, the following equation can be obtained:

$$X^2=l_1^2+l_2^2-2l_1l_2\cdot\cos\theta_1$$

This equation can be rewritten into:

$$\cos\theta_1=l_1^2+l_2^2-X^2/2l_1l_2$$

Accordingly, the angle $\theta_1$ can be represented by:

$$\theta_1=\cos^{-1}(l_1^2+l_2^2-X^2/2l_1l_2)$$

Reference character $\theta_2$ designates an angle formed by the frame situated when the blade is at the present position (BL) and the frame situated when the blade is at the position (BL'). Therefore, the angle $\theta_2$ can be expressed as follows:

$$\theta_2=\theta_0-\theta_1$$

$$=\theta_0-\cos^{-1}(l_1^2+l_2^2-X^2/2l_1l_2)$$

Reference character $\alpha$ is intended to designate an inclination angle which is formed by the longitudinal axis of the bulldozer body with respect to the horizontal reference plane H. Assuming that reference character $\theta_b$ designates an inclination angle of the frame with respect to the horizontal reference plane H, as is apparent from FIG. 1, $\theta_b=\theta_2+\alpha$. If this equation is substituted into the term $\theta_2$ of the above-described equation, then $$\theta_b=\theta_0-\cos^{-1}(l_1^2+l_2^2-X^2/2l_1l_2)+ \quad \ldots (1)$$

Thus, the inclination angle $\theta$b of the frame corresponds to the height of the blade BL measured from the horizontal reference plane H.

In the equation (1), $l_1$, $l_2$, and $\theta_0$ are constants. Therefore, if the lift cylinder stroke X and the bulldozer body inclination angle $\alpha$ are detected, data corresponding to the height of the blade BL from the horizontal reference plane H can be obtained.

Now, one preferred example of an automatic control system according to this invention will be described with reference to FIG. 2.

A blade 3 is secured to one end portion of a frame 2 the other end portion of which is pivotally supported by a bulldozer body 1. The blade 3 is moved up and down by a pair of lift cylinders 4 provided between the body 1 and the frame 2. A direction switching valve 5 is provided for selectively setting the lift cylinders 4 to an extending position (5B), a contracting position (5A), a holding position (5C), and a floating position (5D). In other words, the valve 5 has four switching positions 5A through 5D to set the cylinders 4 to the aforementioned four positions, respectively. The valve 5 is coupled through a rod 6a to the cylinder section 6b of an operating cylinder 6 (hereinafter referred to as "a slave cylinder" when applicable). The piston rod 6c of the slave cylinder 6 is coupled to a blade lifting manual lever 7. A locking mechanism 8 is to lock the manual lever 7 when the blade is automatically controlled. The locking mechanism 8 is association with a switch 33 adapted to change over the manual-automatic control of the blade in such a manner that the switch 33 is turned on, or closed, when the manual level 7 is locked, and it is turned off, or opened, when the manual lever 7 is unlocked. First and second electromagnetic valves 9 and 10 are provided for driving the aforementioned slave cylinder 6. These electromagnetic valves 9 and 10 are connected to hydraulic lines extending between the slave cylinder 6 and a hydraulic pump $P_2$, and are switched in response to output signals $E_8$, $E_9$ and $E_{10}$ of a logic circuit 27 described later. During the manual control of the blade, the valves 9 and 10 are switched respectively to closed positions 9C and 10A, so that the slave cylinder 6 is hydraulically locked, and the manual lever 7 and the rod 6a are therefore fixedly secured. Thus, the operator can manually set the direction switching valve 5 to a desired switching position by the use of the manual lever 7.

On the other hand, during the automatic control, the manual lever 7 is locked by the locking mechanism 8. Accordingly, the first electromagnetic valve 9 operates to cause the cylinder section 6b of the slave cylinder 6 to move forward and backward with respect to the piston rod 6C according to the switching positions 9A and 9B, thereby to set the direction switching valve 5 to a desired switching position. The second electromagnetic valve 10 assists the direction switching valve 5 to return to its original position with the aid of the elastic force of a spring. When the valve 10 is switched to the position 10B, the upper and lower chambers thereof are connected directly to a tank $T_3$, as a result of which the slave cylinder 6 can move freely.

A bulldozer body inclination angle detector 11 detects the inclination angle of the bulldozer body 1 with respect to the reference horizontal plane. The detector 11 is provided substantially at the gravity center of the bulldozer body 1. The detector 11 produces an inclination angle detection signal $e_1$ corresponding to an inclination angle of the body 1, which is applied to a first arithmetic unit 13. Since the bulldozer body inclination angle detector 11 is provided substantially at the gravity center of the body 1 as was described above, the inclination angle of the body 1 can be detected accurately, being not affected by a rotating moment due to the inclination of the body in the longitudinal direction thereof.

A cylinder stroke detector 12 is juxtaposed with the blade lifting cylinder 4. This detector 12 operates to detect a stroke of the cylinder 4 to produce a cylinder stroke detection signal $e_2$ which is applied to the first arithmetic unit 13. This arithmetic unit 13 is a circuit for carrying out the operation of the aforementioned equation (1). Data representative of the body inclination angle, and data representative of the lift cylinder stroke X are provided to the arithmetic unit 13 respectively by the inclination detection signal $e_1$ and the stroke detection signal $e_2$. As a result, a blade height feedback signal $e_h$ corresponding to the height of the blade 3 from the horizontal reference plane H (the frame's inclination $\theta$b) is outputted by the arithmetic unit 13.

A blade height setting device 16 sets a selected height of the blade from the horizontal reference plane H in advance. The device 16 produces a blade height set signal $E_H$ corresponding to the height of the blade thus set. This signal $E_H$ is applied to a second arithmetic unit 14.

This second arithmetic unit 14 operates to obtain a deviation $E_1$ between the height set signal $E_H$ and the feedback signal $e_h$. According to this deviation $E_1$, the slave cylinder 6 is driven, the valve 5 is switched, and the lift cylinder 4 is suitably driven. Thus, the automatic control is carried out so that the present height $e_h$ of the blade 3 coincides with the set height $E_H$ (that is, the deviation $E_1=0$).

A throttle lever opening degree detector 17 detects the throttle opening degree of a throttle lever (not shown) adapted to control the speed of an engine (not shown) driving the bulldozer 1, thereby to produce a throttle opening degree signal $e_4$ corresponding to the throttle opening degree. The throttle opening degree signal $e_4$ is applied to an arithmetic circuit 19.

An engine speed detector 18 detects the speed of the aforementioned engine for driving the bulldozer 1 to produce an engine speed signal $e_5$ corresponding to the speed of the engine. This signal $e_5$ is also applied to the arithmetic circuit 19.

The arithmetic circuit 19 serves to operate a load pressure (corresponding to the wheel's slip) applied to the blade 3 based on the throttle opening degree signal $e_4$ and the engine speed signal $e_5$, thereby to produce a blade load (slip) signal $e_6$ corresponding to the load pressure (slip). The signal $e_6$ is applied to a comparator 21.

A load setting unit 20 is provided for setting the maximum load pressure which can be applied to the bulldozer's blade 3 according to the work conditions. This load setting unit 20 produces a load setting signal $e_7$ corresponding to the set value and applied the signal $e_7$ to the comparator 21.

In the comparator 21 the blade load signal $e_6$ is compared with the load setting signal $e_7$. When the former signal $e_6$ exceeds the latter signal $e_7$, or the blade 3 is overloaded, the comparator 21 outputs an overload signal $e_8$ corresponding to the overload and applies it to an arithmetic unit 14.

Under the normal conditions, the arithmetic unit 14 outputs a deviation signal $E_1$ between the blade height set signal $E_H$ and the blade height feedback signal $e_h$. However, upon application of the overload signal $e_8$ due to the overloading of the blade, the arithmetic unit 14 applies to a pulse control circuit 22 a signal for releasing the feedback control of the blade and for instructing the blade to move upward until the overload signal $e_8$ is eliminated.

The pulse control circuit 22 produces a pulse signal $E_2$ whose pulse width is proportional to the magnitude of the deviation signal $E_1$ produced by the arithmetic unit 14.

Figure 3:
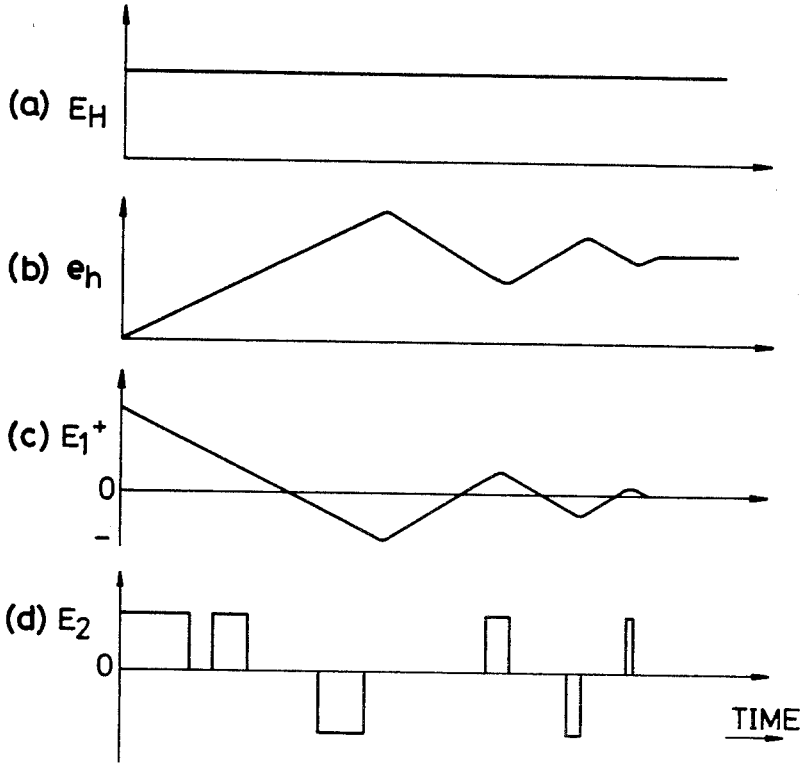
FIG. 3 is timing charts for a description of one example of the operation of the embodiment shown in FIG. 2.

Shown in (a) through (d) of FIG. 3 are timing charts indicating examples of the blade height set signal $E_H$, blade height feedback signal $e_h$, deviation signal $E_1$, and pulse signal $E_2$. In the case when the sign of the deviation signal $E_1$ is positive, the pulse signal $E_2$ provided is for moving the blade upward. In contrast, in the case when the sign of the deviation signal $E_1$ is negative, the pulse signal $E_2$ provided is for moving the blade downward.

A spool position detector 15 operates to detect the spool position of the direction switching valve 5 coupled to the rod 6*a* by detecting the position of the rod 6*a*, thereby to produce a spool position detection signal $e_3$ which is applied to a comparator 24.

The comparator 24 compares the pulse signal $E_2$ with the actual spool position signal $e_3$ of the direction switching valve 5 detected by the spool position detector 15. When the difference between the two signals $E_2$ and $e_3$ is greater than an inoperating width $E_3$ set by an inoperating width setting unit 23, the comparator 24 produces control signals $E_4$ and $E_5$ for moving the blade respectively upward and downward. These signals $E_4$ and $E_5$ are applied to a logic circuit 27. A switch 28 provided between the pulse control circuit 22 and the comparator 24, and a switch 29 provided between the comparator 24 and a blade lifting/floating setting unit 26 are in association with the operation of a forward-backward lever 25. When the lever 25 is set to its forward position, or the bulldozer 1 is moved forward, the switch 28 is turned on, while the switch 29 is turned off. In contrast, when the lever 25 is set to its backward position, or the bulldozer 1 is moved backward, the switch 28 is turned off, while the switch 29 is turned on. Accordingly, when the bulldozer 1 is moved forward, the pulse control circuit 22 is connected to the comparator 24, so that the pulse signal $E_2$ produced by the pulse control circuit 22 is applied to the comparator 24, and the control signals $E_4$ and $E_5$ for moving the blade respectively upward and downward are applied to the logic circuit 27. In contrast, when the bulldozer 1 is moved backward, the pulse control circuit 22 is disconnected from the comparator 24 while the blade lifting/-floating setting unit 26 is connected to the comparator 24. As a result, the blade automatic control system concerning the pulse signal $E_2$ is placed in off state, and the blade lifting/floating setting signal $E_7$ is applied to the comparator 24 to hold the blade 3 in lifting or floating state.

The blade lifting/floating setting unit 26 is to selectively place the blade in the lifting state or in the floating state when the bulldozer 1 is moved backward. The signal $E_7$ of the unit 26 assumes a value corresponding to the lifting position 5A of the direction switching valve 5 when blade lifting has been set and a value corresponding to the floating position 5D of the valve 5 when blade floating has been set.

When the bulldozer is started, the body inclination angle detector 11 is liable to erroneously operate, being affected by the acceleration. In order to overcome this difficulty, an arrangement is made to hold the output of the logic circuit 27 for a predetermined period of time t from the start of the bulldozer. At the start of the bulldozer, the forward signal $E_6$ from the forward-backward lever circuit 25 rises, and therefore a timer 30 is actuated. During the operation time t of the timer 30, a hold circuit 31 is operated. Accordingly, the hold circuit 31 serves to hold the blade raising control signal $E_4$ or the blade lowering control signal $E_5$ appearing before the start of the bulldozer, for the above-described period of time t. Therefore, the blade automatic control system is held for the period of time t. As a result, the erroneous operation of the body inclination angle detector caused by the acceleration at the start of the bulldozer can be eliminated.

Under the normal conditions, the control signals $E_4$ and $E_5$ described above are not held and are produced, as a blade raising signal $E_8$ and a blade lowering signal $E_9$, by the logic circuit 27 through the hold circuit 31. The signals $E_8$ and $E_9$ thus produced are applied to the solenoids 9S*a* and 9S*b* of the electromagnetic valve 9, respectively. It should be noted that the signal $E_8$ or $E_9$ is provided for one of the control signals $E_4$ and $E_5$.

When both of the control signals $E_4$ and $E_5$ are zero; that is, it is unnecessary to move the blade upward or downward, a pulse generator 32 is operated to produce a neutral control signal $E_{10}$ having a predetermined pulse width. This neutral control signal $E_{10}$ energizes the solenoid 10S of the electromagnetic valve 10 so that the latter 10 is switched to the position 10B. As a result, the slave cylinder 6 is set free, and the direction switching valve 5 is quickly switched to the neutral position 5C with the aid of the returning spring 5E thereof.

The aforementioned change-over switch 33 is to switch the manual and automatic controls of the blade 3, and is in association with the locking mechanism 8. When the manual lever 7 is locked, the change-over switch 33 is turned on, whereby the above-described control signal $E_8$, $E_9$ and $E_{10}$ are applied to the respective electromagnetic valve switching solenoids. Thus, the whole system is set to be able to perform the automatic control of the blade 3.

As is apparent from the above description, during the normal forward movement, the pulse signal $E_2$ for instructing to move the blade upward or downward according to the deviation signal between the present height signal $e_h$ of the blade 3 and the height set signal $E_H$ of the same is provided. Accordingly, the automatic control is effected so that the spool position of the direction switching valve 5 coincides with the blade raising position (5A) or blade lowering position (5B) instructed by the pulse signal $E_2$, or with the neutral position (5C). In addition, upon detection of the overloading of the blade 3, the signal $e_8$ operates to block the deviation data between the signals $E_H$ and $e_h$, and therefore the signal $E_1$ will be forced to have a content of instructing the upward movement of the blade. On the other hand, during the backward movement, the switch 28 is in the off state, while the switch 29 is in the on state, and therefore instead of the pulse signal $E_2$ the blade lifting or floating control signal $E_7$ is applied to the comparator 24. As a result, the direction switching valve 5 is so controlled as to switch to the position 5A or 5D. If the value of the setting signal $E_7$ in selecting the "lifting" coincides with the value of the spool position detection signal $e_3$, then it is assumed that the direction switching valve 5 has been switched to the lifting position 5A, and therefore the output of the comparator 24 becomes zero. Furthermore, if the value of the setting signal $E_7$ in selecting the "floating" coincides with the value of the spool position detection signal $e_3$, it is assumed that the direction switching valve 5 has been switched to the floating position 5D, and therefore the output of the comparator 24 becomes zero. Upon application of the blade lowering control signal $E_9$, the rod 6*a* is moved in the direction of the arrow A; while upon application of the blade raising control signal $E_8$, the rod 6*a* is moved in the direction of the arrow $\overline{A}$.

Figure 2:
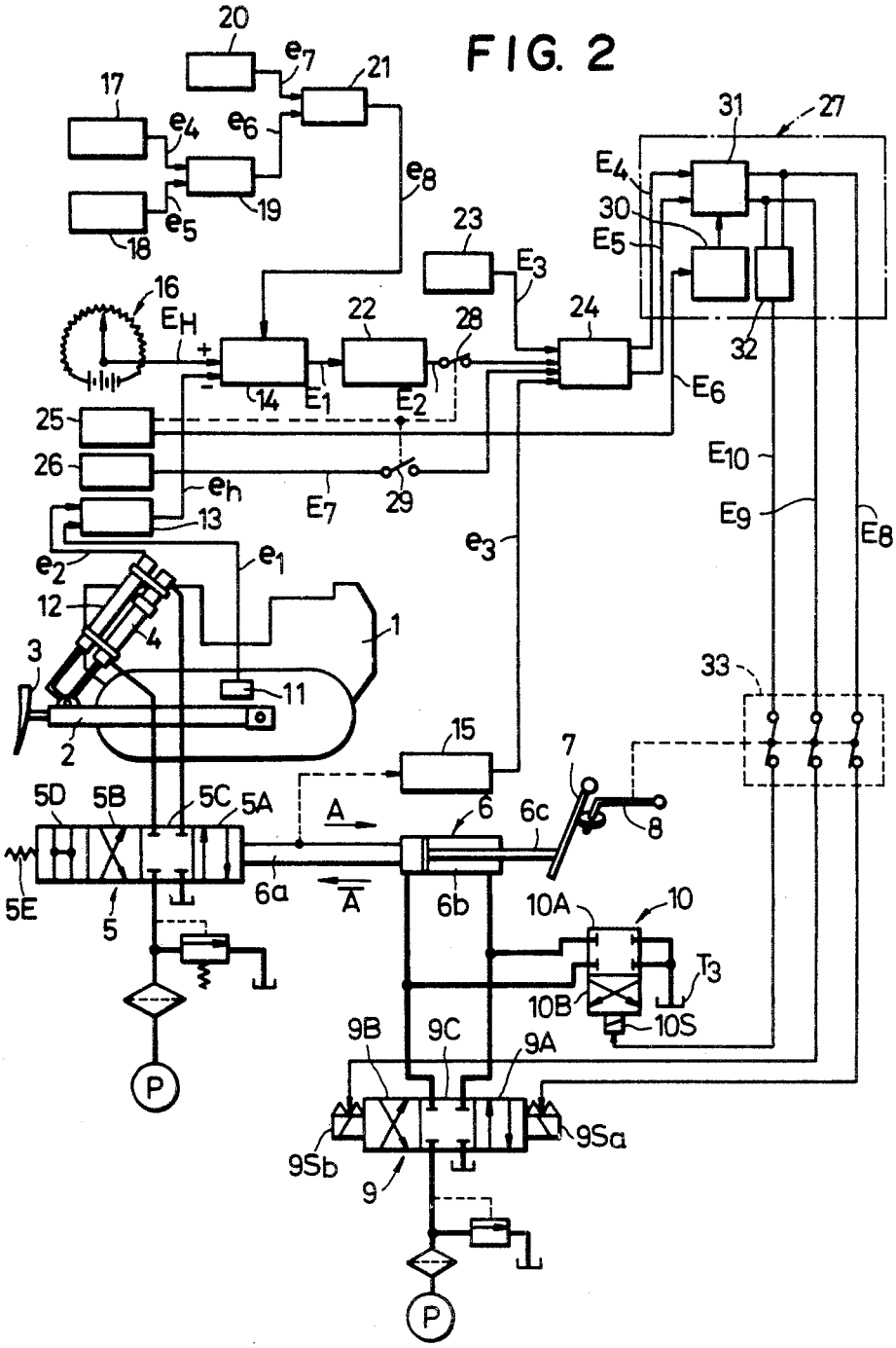
FIG. 2 is a block diagram showing one embodiment of the invention.
Figure 4:
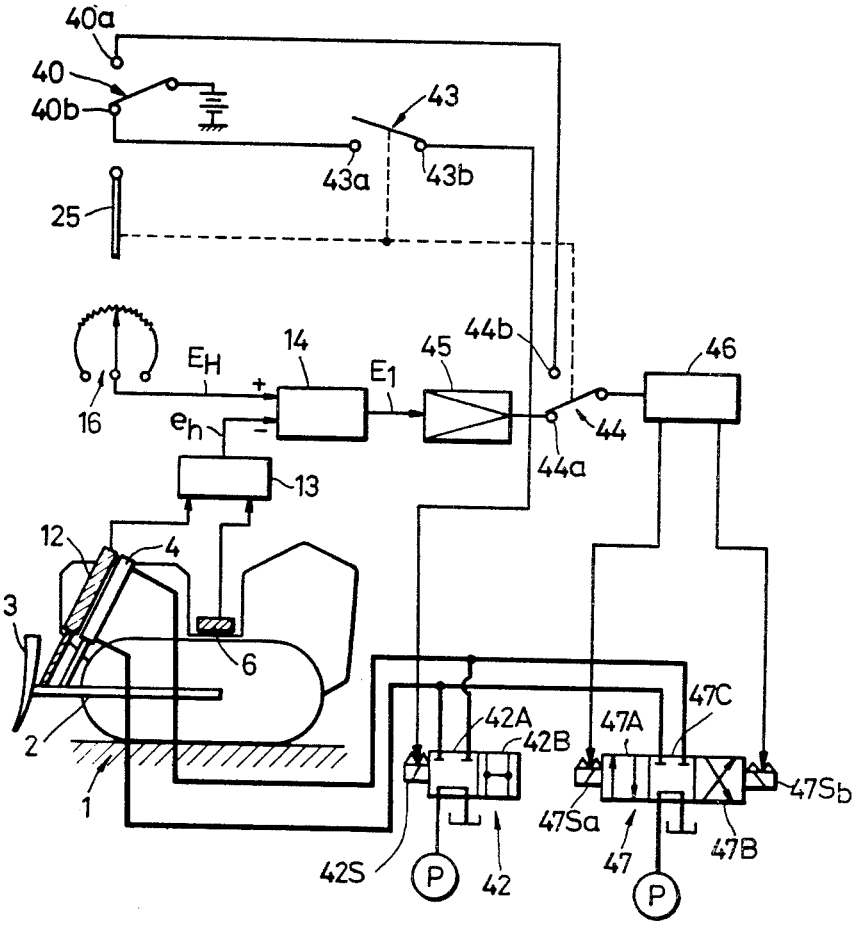
FIG. 4 is a block diagram illustrating another embodiment of the invention.

FIG. 4 is a block diagram illustrating another embodiment of this invention whose control system is simpler than that of the first embodiment shown in FIGS. 2 and 3. More specifically, the second embodiment is different from the first embodiment mainly in that the control during the overload operation is omitted, and switching between the automatic and manual controls is not carried out; that is, only the automatic control is conducted. Accordingly, the parts in the second embodiment similar to those in the first embodiment will be briefly described or omitted, and only the parts thereof different from those of the first embodiment will be described in detail.

Referring to FIG. 4, the arithmetic unit 14 operates to subtract the signal $e_h$ from the signal $E_H$ thereby to produce the deviation signal $E_1$ similarly as in the case of the first embodiment. This deviation signal $E_1$, after being amplified by an amplifier 45, is applied to a comparison circuit 46. The comparison circuit 46 has an inoperating width of from $+\frac{1}{2}\delta$ to $-\frac{1}{2}\delta$. However, this inoperating width is suitably determined according to the kinds of work. The comparison circuit 46 produces no output when the input signal applied thereto from the amplifier 45 is within the inoperating width $\delta$. However, the comparison circuit produces a signal $+V$ of one polarity when the input signal is higher than $+\frac{1}{2}\delta$; and it produces a signal $-V$ of the opposite polarity when the input signal is lower than $-\frac{1}{2}\delta$. The output signals $+V$ and $-V$ of the comparison circuit 46 are applied to the solenoids 47Sa and 47Sb of an electromagnetic switching valve 47, respectively. Upon application of the output signal $+V$, the electromagnetic switching valve 47 is switched to its position 47A. As a result, the pressurized oil is allowed to flow from a hydraulic pump p through a hydraulic cylinder 4 to a tank T so as to raise the hydraulic cylinder 4. In contrast, upon application of the output signal $-V$, the electromagnetic switching valve is switched to its position 47B, and the hydraulic cylinder 4 is moved downward. When no signal is applied to the electromagnetic switching valve 47, it is switched to the neutral position 47C, and therefore the hydraulic cylinder 4 will not be moved. Thus, the height of the blade is controlled by driving the hydraulic cylinder 4 until the value of the blade height signal coincides with the set value.

In a blade position control system as described above, a lifting and floating change-over switch 40 is switched to the lifting side or the floating side in advance in order that when the bulldozer is moved backward, the blade is placed in the lifting state or in the floating state. In other words, the change-over switch 40 is to selectively have the blade lifted or floated when the bulldozer is moved backward. When the switch 40 is switched to the contact 40*a*, the blade is lifted; and when it is switched to the contact 40*b*, the blade is maintained floated. The changeover switch 40 is manually operated by the operator. Other changeover switches 43 and 44 are operated in association with the forward-backward lever 25. When the lever 25 is set to the forward position, the change-over switch 43 is opened (off), while the change-over switch 44 is switched to the contact 44*a*. When the lever 25 is set to the backward position, the switch 43 is closed, while the switch 44 is switched to the contact 44*b*. In the case where it is intended to have the blade 3 floated when the bulldozer is moved backward, the switch 40 is maintained connected to the floating side contact 40*b*. Then, the lever 25 is set to the backward position, as a result of which the switch 43 is closed, and the switch 44 is switched to the contact 44*b* from the contact 44*a*. Therefore, the comparison circuit 46 is disconnected from the amlifier 45 . . . That is, the above-described automatic mode operation is suspended, the solenoid 42S of the two-position electromagnetic valve 42 is energized, so that the spool position is switched to the position 42B, and the electromagnetic valve 42 is placed in the open state, whereupon the hydraulic cylinder 4 becomes freely movable irrespective of the hydraulic oil therein; that is, the blade 3 is maintained floated.

On the other hand, in the case where it is intended to have the blade lifted when the bulldozer is moved backward, the change-over switch 40 is maintained connected to the lifting side contact 40*a*. Then, the forward-backward lever 25 is set to the backward position. As a result, the switch 43 is closed, while the switch 44 is switched to the contact 44*b* from the contact 44*a*. In this case, as the circuit from the contact 40*b* is open, the electromagnetic valve 42 is switched to the position 42A. That is, the electromagnetic valve 42, being in the closed state, does not operate. Accordingly, the circuit from the lifting side contact 40*a* through the switch 44 and the comparison circuit 46 to the three-position electromagnetic valve 47 is closed.

With the aid of a signal provided through the switch 44, the comparator 46 produces the blade lifting signal to switch the electromagnetic valve 47 to the position 47A. Accordingly, the hydraulic cylinder 4 is contracted to place the blade 2 in the lifting state.

While the second embodiment of the invention has been described with reference to the case where the blade is controlled by the signals produced by the blade position detector and the body inclination angle detector, it should be noted that the invention is not limited thereto or thereby. For instance, the technical concept of the invention can be applied to a control system in which the blade height control is carried out by the utilization of the aforementioned laser light beam.

What is claimed is:

1. An automatic control system for a working tool on a civil machine comprising a vehicle having a travelling mechanism and a driving means for driving the travelling mechanism, which comprises:

a. stroke detecting means for detecting an amount of stroke of a lifting cylinder device which expands and contracts to move said working tool up and down;

b. inclination angle detecting means for detecting an inclination angle of said vehicle with respect to the absolute horizontal plane;

c. a first arithmetic means for computing data representative of a height of said working tool with the aid of detection signals produced by said stroke detecting means and inclination angle detecting means; and d. position setting means for setting a position of said working tool in advance;

e. a first detector means for detecting a throttle opening degree of an engine of said vehicle;

f. a second detector means for detecting a speed of said engine;

g. a second arithmetic means for receiving detection signals from said first and second detector means for detecting a throttle lever opening degree of the engine and said detector means for detecting a speed of said engine to produce a load signal;

h. comparator means which operates to compare said load signal with a set load value and which, when the load signal exceeds the set load value, produces an overload signal; and i. a third arithmetic means which receives a position setting signal from said position setting means, a working tool present position signal from said first arithmetic means, and an output from said second arithmetic means, and which when no overload signal is applied thereto produces a deviation signal between said position setting signal and said present position signal, and when said overload signal is applied thereto produces a signal instructing to release said position setting signal and present position signal to decrease load on the basis of said overload signal, said lifting cylinder being controlled by an output of said third arithmetic means.

2. A system as claimed in claim 1, which further comprises means which receives an output of said third arithmetic means and produces a pulse signal whose pulse width is proportional to a magnitude of said deviation signal, and means for producing a control signal for controlling a position of said working tool with the aid of said pulse signal.

3. An automatic control system for a working tool on a civil machine comprising a vehicle having a travelling mechanism and a driving means for driving the travelling mechanism which comprises:

a. means for obtaining data representative of a present position of said working tool, wherein said tool is positioned up and down by a lift cylinder;

b. position setting means for setting a position of said working tool in advance;

c. comparison means for comparing said data with a set value provided by said position setting means; and d. hydraulic pressure means for controlling said lifting cylinder with the aid of a deviation signal provided by said comparison means, said hydraulic pressure means comprising;

$d_1$. a hydraulic pressure direction switching valve provided between a hydraulic pressure source and a lift cylinder;

$d_2$. a slave cylinder coupled directly to a spool of said switching valve;

$d_3$. an electromagnetic valve provided between said slave cylinder and said hydraulic pressure source and operated by the control signal produced with the aid of said deviation signal; and $d_4$. an automatic-manual switching control electromagnetic valve provided in a hydraulic pipe line connecting said electromagnetic valve to said slave cylinder.

4. An automatic control system for a working tool on a civil machine comprising a vehicle having a travelling mechanism and a driving means for driving the travelling mechanism, which comprises;

a. height detecting means for detecting a height of said working tool;

b. height setting means for setting a height of said working tool in advance;

c. subtractor means for producing a difference signal between a detection signal provided by said height detecting means and a signal provided by said height setting means;

d. hydraulic control means for controlling a flow rate and a direction of flow of a hydraulic oil toward a hydraulic cylinder for driving said working tool on the basis of said difference signal;

e. timer means which is operated in association with an operating lever of said driving means, and which starts its operation upon operation of said operating lever to produce a signal for a predetermined period of time; and f. hold circuit means connected between said subtractor means and said hydraulic control means for holding the signal which was applied from said subtractor means thereto immediately before application of the signal from said timer while the signal is being applied from said timer.

5. An automatic control system for a working tool on a civil machine in which a spool position of a three-position electromagnetic valve is switched according to a deviation value between a set position and working tool position so as to change a flow rate and a direction of flow of hydraulic oil with respect to a hydraulic cylinder, said system comprising:

a. a first switch for selecting one of lifting and floating operations of said working tool to provide a floating or lifting signal to a selected one of a floating side contact and a lifting side contact of said first switch;

b. a second switch connected between the floating side contact of said first switch and the solenoid of said two-position electromagnetic valve and operated in association with a forward-backward switching lever of said vehicle, said second switch being closed when said forward-backward switching lever is set to a backward position;

c. a two-position electromagnetic valve juxtaposed with said three-position electromagnetic valve, said two-position electromagnetic valve being switched to open and close respectively upon energization and deenergization of a solenoid thereof which is energized when said second switch is closed and said first switch has selected the floating operation, said valve letting the hydraulic oil free to the outside when said valve is opened and closing the hydraulic oil to the outside when said valve is closed;

d. driving means for driving said three-position electromagnetic valve to the lifting position according to the lifting signal of said first switch while said first switch maintains the lifting operation; and e. a third switch which is operated in association with said forward-backward switching lever, and which operates to apply said deviation value to said driving means when the vehicle is moved forward and to apply the lifting signal from said first switch to said driving means when the vehicle is moved backward.

6. An automatic control system for a working tool on a civil machine according to claim 3 further comprising:

a. an automatic-manual switching lever connected to a rod portion of said slave cylinder;

b. means for setting said lever free during a manual operation and locking said lever during an automatic operation; and c. switching means for cutting an electric signal to the solenoid of said automatic-manual switching control electromagnetic valve and to the solenoid of said electromagnetic valve provided between said slave cylinder and said hydraulic pressure source when said lever is released from a locked state, a cylinder portion and the rod portion of said slave cylinder being mechanically locked during the manual operation thereby allowing the spool of said hydraulic pressure direction switching valve to be manually operated by said lever through said slave cylinder.

7. An automatic control system for a working tool on a civil machine according to claim 3 further comprising:

a. spool position detector means for detecting an amount of displacement of the spool of said hydraulic pressure direction switching valve;

b. a working tool lifting/floating unit for producing a signal used for selectively setting said working tool in a lifting state or a floating state when the vehicle is reversely moved;

c. means for cutting the control by said deviation signal during the reverse running of the vehicle; and d. comparator means for comparing the signal from said working tool lifting/floating unit with the signal from said spool position detector means only during the reverse running of the vehicle, said working tool being set in a lifting or floating state by actuating said hydraulic pressure means by the output of said comparator means.

* * * * *